US010539365B2

(12) United States Patent
Fernandez et al.

(10) Patent No.: US 10,539,365 B2
(45) Date of Patent: Jan. 21, 2020

(54) METHOD AND APPARATUS FOR CRYOGENIC SEPARATION OF A MIXTURE CONTAINING AT LEAST CARBON MONOXIDE, HYDROGEN AND NITROGEN

(71) Applicant: L'Air Liquide, Societe Anonyme pour l'Etude et l'Exploitation des Procedes Georges Claude, Paris (FR)

(72) Inventors: Angela Fernandez, Paris (FR); Pascal Marty, Bry sur Marne (FR); Bhadri Prasad, Champigny sur Marne (FR); Marie-Pascal Victor, Paris (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 455 days.

(21) Appl. No.: 15/024,124

(22) PCT Filed: Sep. 23, 2014

(86) PCT No.: PCT/FR2014/052368
§ 371 (c)(1),
(2) Date: Mar. 23, 2016

(87) PCT Pub. No.: WO2015/044575
PCT Pub. Date: Apr. 2, 2015

(65) Prior Publication Data

US 2016/0245583 A1 Aug. 25, 2016

(30) Foreign Application Priority Data

Sep. 24, 2013 (FR) ..... 13 59155

(51) Int. Cl.
*F25J 3/00* (2006.01)
*F25J 3/02* (2006.01)

(52) U.S. Cl.
CPC ..... *F25J 3/0223* (2013.01); *F25J 3/0233* (2013.01); *F25J 3/0252* (2013.01); *F25J 3/0257* (2013.01);
(Continued)

(58) Field of Classification Search
CPC ..... F25J 3/02452; F25J 3/0257; F25J 3/0261; F25J 3/0233; F25J 2280/02;
(Continued)

(56) References Cited

U.S. PATENT DOCUMENTS 4,544,390 A * 10/1985 Traficante ..... C01B 3/025 62/632
4,805,414 A * 2/1989 Fisher ..... C01B 3/506 62/630

(Continued)

FOREIGN PATENT DOCUMENTS

| | | |
|---|---|---|
| EP | 0 928 936 | 7/1999 |
| FR | 2 895 067 | 6/2007 |
| WO | WO 2008 099 124 | 8/2008 |

OTHER PUBLICATIONS

LINDE AG: "Cryogenic Gas Separation: The most economic and experienced separation process for production of Carbon Monoxide and Hydrogen from raw synthesis gas," Oct. 31, 2012, pp. 1-11.

(Continued)

*Primary Examiner* — Keith M Raymond
(74) *Attorney, Agent, or Firm* — Justin K. Murray

(57) ABSTRACT

The invention relates to an apparatus for cryogenic separation of a mixture of carbon monoxide, hydrogen and nitrogen, including a stripping column and a denitrogenation column, a pipe for sending the mixture in liquid form to the head of the stripping column, a pipe for removing a liquid depleted of hydrogen connected to the stripping column, a pipe for removing a gas enriched with hydrogen from the (Continued)

stripping column, means for sending the liquid depleted of hydrogen or a fluid derived from said liquid to the denitrogenation column, a pipe for drawing a liquid enriched with carbon monoxide from the denitrogenation column, a pipe for drawing a gas enriched with nitrogen from the head of the denitrogenation column and means for sending at least one portion of the gas enriched with hydrogen to the denitrogenation column.

9 Claims, 2 Drawing Sheets

(52) U.S. Cl.
CPC ..... *F25J 3/0261* (2013.01); *F25J 3/0295* (2013.01); *F25J 2200/70* (2013.01); *F25J 2200/72* (2013.01); *F25J 2205/04* (2013.01); *F25J 2235/60* (2013.01); *F25J 2245/02* (2013.01); *F25J 2280/02* (2013.01)

(58) Field of Classification Search
CPC ..... F25J 2200/72; F25J 3/0223; B01D 2257/502; B01D 2257/102; B01D 2257/108; C01B 3/506
See application file for complete search history.

(56) References Cited

U.S. PATENT DOCUMENTS

| | | | | |
|---|---|---|---|---|
| 6,098,424 | A * | 8/2000 | Gallarda | C01B 3/025 62/632 |
| 7,269,972 | B2 * | 9/2007 | Davey | C01B 3/506 62/617 |
| 9,459,043 | B2 * | 10/2016 | Briglia | F25J 3/0223 |
| 9,909,803 | B2 * | 3/2018 | McNeil | C01B 3/506 |
| 2010/0047150 | A1 | 2/2010 | Briglia et al. | |
| 2010/0150813 | A1 | 6/2010 | Briglia et al. | |
| 2010/0223952 | A1 * | 9/2010 | McNeil | F25J 3/0223 62/622 |
| 2010/0251765 | A1 * | 10/2010 | McNeil | C01B 3/506 62/632 |
| 2012/0279254 | A1 * | 11/2012 | Darde | F25J 3/0223 62/617 |
| 2014/0090416 | A1 * | 4/2014 | McNeil | C01B 3/506 62/618 |

OTHER PUBLICATIONS

International Search Report and Written Opinion for PCT/FR2014/052368, dated Aug. 5, 2015.

* cited by examiner

METHOD AND APPARATUS FOR CRYOGENIC SEPARATION OF A MIXTURE CONTAINING AT LEAST CARBON MONOXIDE, HYDROGEN AND NITROGEN

CROSS REFERENCE TO RELATED APPLICATIONS

This application is a § 371 of International PCT Application PCT/FR2014/052368, filed Sep. 23, 2014, which claims the benefit of FR1359155, filed Sep. 24, 2013, both of which are herein incorporated by reference in their entireties.

TECHNICAL FIELD OF THE INVENTION

The present invention relates to a method and to an apparatus for the cryogenic separation of a mixture containing at least carbon monoxide, hydrogen and nitrogen. The nitrogen content may fluctuate.

BACKGROUND OF THE INVENTION

It is known practice to separate such a mixture by cryogenic distillation, using at least one stripping column which serves to reduce the $H_2$ content of the CO, followed by a nitrogen-removal column which is a $CO/N_2$ separation column.

Head condensers at the top of the $CO/N_2$ columns are of the "water bath vaporizer" type.

When the $N_2$ content in the mixture (which means to say the $N_2$ content entering the $CO/N_2$ column) is far lower than the content used as a basis for designing the $CO/N_2$ column, the installed condenser has, de facto an excess heat-exchange surface area which leads to all of the $CO/N_2$ mixture becoming condensed at the bottom of the tank, the result of this being that the column operating pressure can no longer be maintained. It is then no longer possible to maintain the purity of the CO that is to be produced, and that results in a risk of the unit shutting down. One way of reducing the exchange surface area of the condenser is to lower the level of the bath (liquid CO—partially "unflood" the condenser) but there is a limit to this principle caused by the fact that the condenser is of the "thermosiphon" type, namely is designed for a recirculation rate that requires a minimum liquid charge in order to operate correctly, the minimum head of liquid required not necessarily being aligned with the head to which it needs to be set in order to manage very low $N_2$ contents.

The risks associated with excessively low $N_2$ contents in the $CO/N_2$ column are generally compensated for through the possibility of importing and injecting gaseous $N_2$ into the impure-CO line feeding the column in order to guarantee the operational stability of the "water bath vaporizer" condenser and the stability of the operating pressure in the column.

FR-A-2895067 and WO-A-2008/099124 describe solutions using an addition of nitrogen if the nitrogen content in the mixture drops.

EP-A-0928936 and "Cryogenic Gas Separation: The most economic and experienced separation process for production of carbon monoxide and hydrogen from raw synthesis gas" by Linde AG describe methods according to the closest prior art.

SUMMARY OF THE INVENTION

One subject of the invention provides a method for the cryogenic separation of a mixture containing at least carbon monoxide, hydrogen and nitrogen in which:

the mixture, in liquid form, is sent to the top of a stripping column where it separates to form a hydrogen-lean liquid and a hydrogen-enriched gas and the hydrogen-lean liquid or a fluid derived from this liquid is sent to a nitrogen-removal column where it separates to form a carbon monoxide-enriched liquid and a nitrogen-enriched gas containing the majority of the nitrogen present in the mixture wherein:

if the nitrogen content of the mixture and/or of the nitrogen-enriched gas and/or, in the case of variant ii), of a carbon monoxide-enriched gas, is below a threshold, i) at least part of the hydrogen-enriched gas coming from the stripping column is sent to an intermediate point of the nitrogen-removal column, or ii) if the fluid is derived from the hydrogen-lean liquid by distillation in a separation column, at least part of the hydrogen-enriched gas from the stripping column is sent to an intermediate point of the column to the separation column, the carbon monoxide-enriched gas is removed from the top of the separation column and an uncondensed gas from a head condenser at the top of the separation column is sent to the nitrogen-removal column.

According to other optional subjects:

in variant ii), the mixture contains methane and the hydrogen-lean liquid is sent to the separation column, the latter having a head condenser at the top, a methane-enriched liquid being produced at the bottom and a carbon monoxide-enriched gas being tapped off at the top of the column.

it is a detector of the flow rate of the nitrogen-enriched gas that triggers the sending of hydrogen-enriched gas to the separation column or to the nitrogen-removal column.

in the case of variant ii) it is a detector of the nitrogen-enriched flow rate at the top of the nitrogen-removal column that triggers the sending of gas not condensed in the condenser to the nitrogen-removal column.

in the case of variant ii) the separation column is decoupled in terms of pressure from the nitrogen-removal column by a pressure detector on the carbon monoxide-enriched gas at the top of the separation column.

in the case of variant ii) in which the gas not condensed in the condenser is mixed with the carbon monoxide-enriched gas.

in the case of variant ii) in which only if the nitrogen content of the mixture and/or of the carbon monoxide-enriched gas and/or of the nitrogen-enriched gas is below a threshold is at least part of the hydrogen-enriched gas sent to the separation column at an intermediate point of the separation column and is gas from the head condenser which has not condensed there sent to the nitrogen-removal column.

in the case of variant ii), the mixture is a bottom liquor from a methane scrubbing column, the scrubbing liquid coming from the bottom of the separation column.

the mixture is a liquid from a phase separator.

in variant i) the fluid derived from the hydrogen-lean liquid is produced by expanding the liquid through a valve.

Another subject of the invention provides an apparatus for the cryogenic separation of a mixture of carbon monoxide, hydrogen and nitrogen and possibly methane, comprising a stripping column, a nitrogen-removal column and possibly a separation column with a head condenser at the top, a pipe for sending the mixture in liquid form at the top of the stripping column, a pipe for removing a hydrogen-lean liquid, which pipe is connected to the stripping column, a pipe for removing a hydrogen-enriched gas from the stripping column, means for sending the hydrogen-lean liquid or a fluid derived from this liquid to the nitrogen-removal column, a pipe for tapping a carbon monoxide-enriched liquid off the nitrogen-removal column and a pipe for tapping a nitrogen-enriched gas off the top of the nitrogen-removal column, characterized in that it comprises means for sending at least part of the hydrogen-enriched gas or a fluid derived from this gas to the nitrogen-removal column.

The apparatus may comprise a separation column that has a head condenser at the top and in which the means for sending a fluid derived from the hydrogen-enriched gas to the nitrogen-removal column comprise a pipe for sending at least part of the hydrogen-enriched gas to a hydrogen-lean liquid separation column, the pipe being connected to an intermediate point of the separation column, and a pipe for sending a gas from the head condenser which has not condensed there to the nitrogen-removal column.

The apparatus may comprise a separation column having a head condenser at the top, the pipe for removing the hydrogen-lean liquid from the stripping column being connected to the separation column, the pipe for removing a hydrogen-enriched gas being connected to the separation column and comprising a pipe for removing carbon monoxide-enriched gas from the top of the separation column and a pipe for sending an uncondensed gas from the head condenser (6) at the top of the separation column to the nitrogen-removal column.

The apparatus may comprise means for detecting the nitrogen content of the mixture and/or of the nitrogen-enriched gas and/or of the carbon monoxide-enriched gas and means for regulating the flow rate of the at least part of the hydrogen-enriched gas or of the fluid derived from this gas that is sent to the nitrogen-removal column.

The apparatus may comprise means for sending at least part of the hydrogen-enriched gas to the separation column at an intermediate point of the separation column or to the nitrogen-removal column using a detector of the nitrogen content of the mixture and/or of the carbon monoxide-enriched gas and/or of the nitrogen-enriched gas and/or a detector of the flow rate of the mixture and/or of the carbon monoxide-enriched gas and/or of the nitrogen-enriched gas.

One preferred feature of the present invention is that it can compensate for the reduction in nitrogen by importing some of the head gas from the stripping column upstream of the $CO/N_2$ column into the $CO/N_2$ column: the head gas from the stripping column contains hydrogen, making it possible to increase the flow rate of incondensables heading toward the $CO/N_2$ column.

The flow rate of this new line can be controlled by a flow rate control means (FIC). Fitting an incondensables bypass pipe between the stripping column and the $CO/N_2$ affords the following advantages:

- The operating pressure of the $CO/N_2$ column is no longer dependent on the nitrogen content in the impure CO (resulting from the natural gas feeding the synthesis gas generation unit).
- There is no importing of gaseous nitrogen when the $N_2$ content in the cold box charge gas proves to be too low.

The invention will be described in greater detail with reference to the figures which show apparatuses according to the invention.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
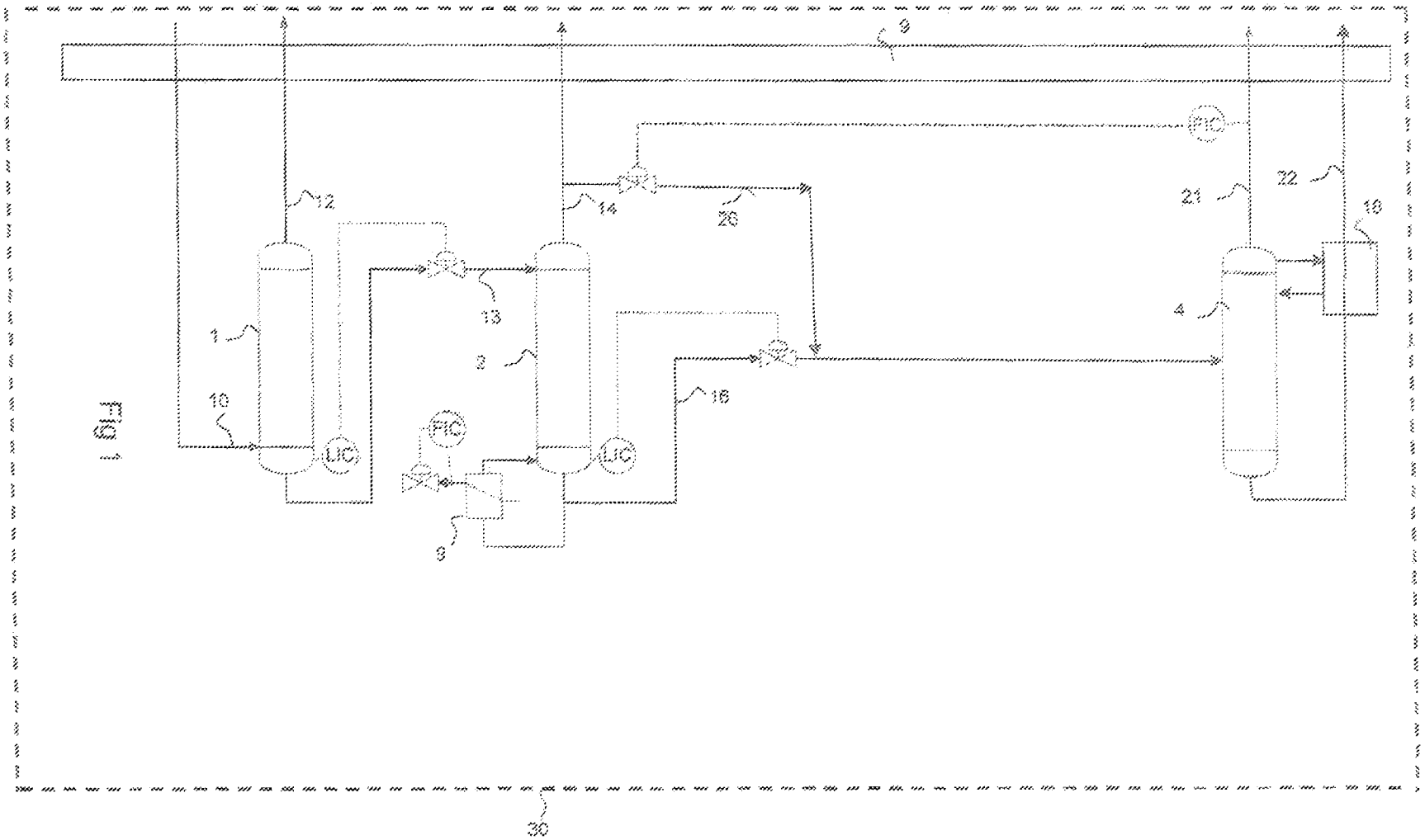
FIG. 1 represents a process flow diagram in accordance with an embodiment of the present invention.

In FIG. 1, a mixture 10 of carbon monoxide, nitrogen and hydrogen is cooled in an exchanger 9 and sent to a distillation column 1 (or separator). A hydrogen-enriched head gas 12 leaves the top of the column 1 and is heated up in the exchanger 9. The bottom liquor 13 is expanded and then sent to the top of a stripping column 2 which is heated at the bottom by a reboiler 8. The hydrogen-enriched head gas 14 is heated up in the exchanger 9 and then burnt. The bottom liquor 15 containing mainly nitrogen and carbon monoxide is expanded and sent to the middle of a nitrogen-removal column 4. The carbon monoxide-enriched bottom liquor 22 is sent to the exchanger 18 where it is used to condense the head gas from the nitrogen-removal column. In the nitrogen-removal column 4, a nitrogen-enriched gas 21 leaves the top of the column.

If the flow rate of nitrogen 21 drops below a given threshold, the valve of the pipe 26 opens and hydrogen-enriched gas is sent from the top of the stripping column to the nitrogen-removal column 4, preferably mixing it with the gas formed by expanding the liquid from the pipe 16 through a valve.

Figure 2:
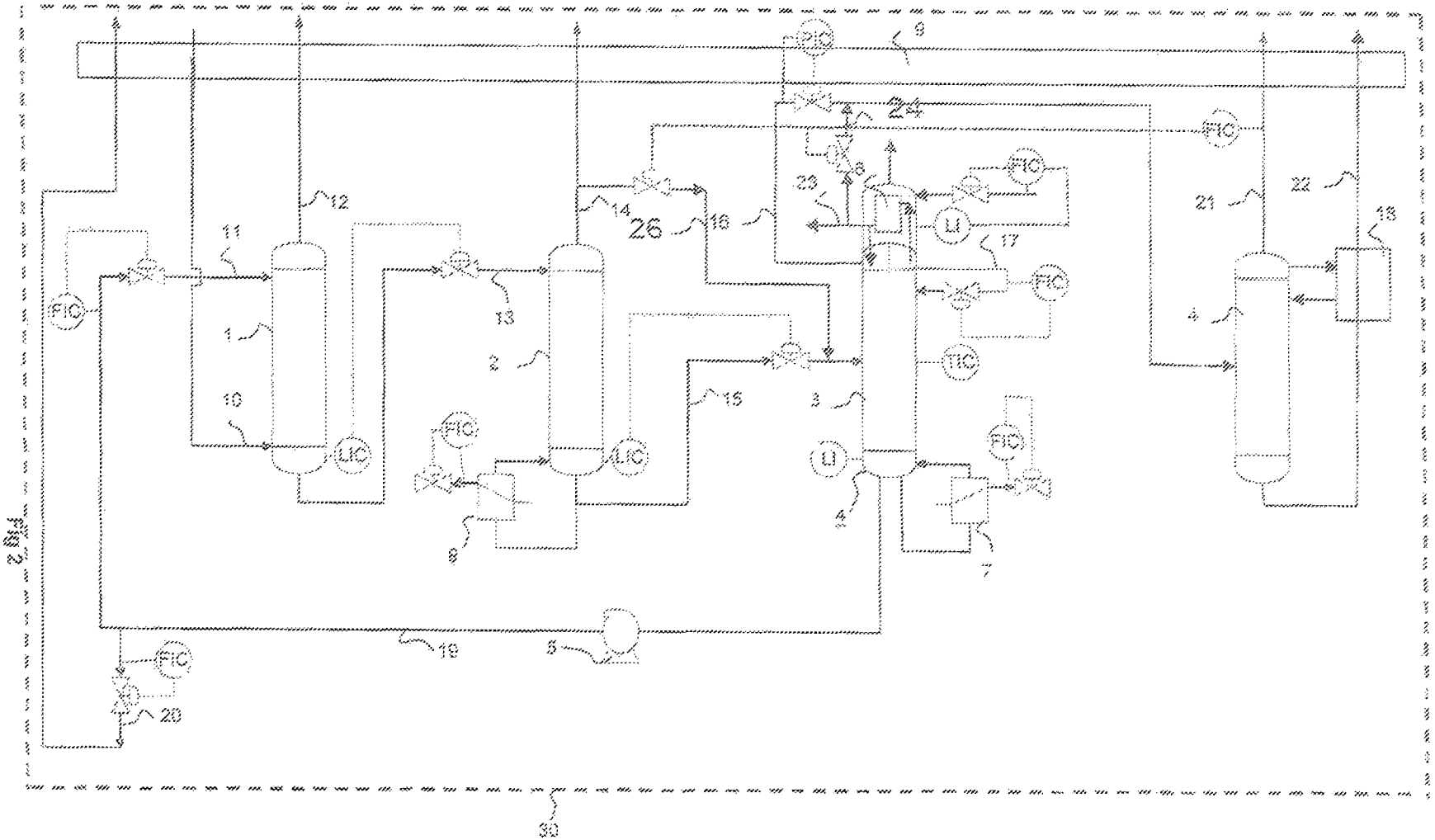
FIG. 2 represents a process flow diagram in accordance with another embodiment of the present invention.

According to FIG. 2, the mixture that is to be separated contains nitrogen, hydrogen, methane and carbon monoxide.

It is known practice to separate such a mixture using cryogenic distillation, using a $CO/CH_4$ separation column followed by a $CO/N_2$ separation column.

The incondensables ($H_2$—$N_2$) from the $CO/CH_4$ column are not put to use: they are sent directly to the flare or to a fuel network.

The $CO/CH_4$ and $CO/N_2$ columns are operated at equal pressures.

The innovative feature consists in compensating for the reduction in nitrogen by importing head gas (which contains hydrogen) coming from the stripping column upstream of the $CO/CH_4$ column, to the $CO/CH_4$ column and then by importing incondensables coming from the $CO/CH_4$ column to the $CO/N_2$ column.

All or part of the head gas from the stripping column (which contains hydrogen) is collected so as to be routed toward the feed of the $CO/CH_4$ column.

Thanks to this new line, the flow rate of incondensables heading toward the $CO/CH_4$ column can be increased.

All or some of the incondensables are then recovered at the top of the $CO/CH_4$ column (which contains hydrogen and does not contain methane) so as to be directed toward the $CO/N_2$ column via the impure-CO line that feeds the $CO/N_2$ column. Thanks to this other new line, the pressure in the $CO/N_2$ column can also be maintained if there is a nitrogen deficit in the CO: the presence of hydrogen compensates for the lack of nitrogen.

The flow rates of each of the new lines are controlled by an FIC.

The pressure in the $CO/CH_4$ column needs to be raised slightly as a result in order to be sure that the flow of incondensables will indeed be directed toward the $CO/N_2$ column.

The flow rate of impure CO is controlled by a PIC added to the $CO/CH_4$ column so that the two operating pressures of the columns can be decoupled from one another.

The incondensables at the top of the $CO/N_2$ column are then directed toward the fuel network via the $N_2$ purge line which passes via the exchange line.

A mixture 10 of carbon monoxide, nitrogen, hydrogen and methane is cooled in an exchanger 9 and sent to a methane scrubbing column 1 fed at the top with liquid methane 11 or to a separator. A hydrogen-enriched head gas 12 leaves the top of the column 1 and is heated up in the exchanger 9. The bottom liquor 13 is expanded and then sent to the top of a stripping column 2 reheated at its bottom by a reboiler 8. The hydrogen-enriched head gas 14 is heated up in the exchanger 9 and then burnt. The bottom liquor 15 containing mainly methane and carbon monoxide is expanded and sent to the middle of a distillation column 3 having a bottom reboiler 7 and a head condenser 6. A flow of incondensable gases 22 leaves this condenser 6. A carbon monoxide-enriched head gas 16 leaves the column 3 and is sent to the nitrogen-removal column 4. The methane-enriched bottom liquor is pumped by the pump 5, and split into two. One part 20 is vaporized in the exchanger 9 and the rest is fed to the scrubbing column 1 as flow 11.

In the nitrogen-removal column 4, a nitrogen-enriched gas 21 leaves the top of the column and a liquid 22 leaves the bottom enriched in carbon monoxide. The carbon monoxide vaporizes in the head condenser 18 which is a water bath vaporizer.

There is a pipe 26 connecting the head gas outlet 14 of the column 2 to the liquid pipe 15 entering the column 3. There is also a pipe 24 that allows incondensable gas to be sent from the condenser 6 to the nitrogen-removal column, particularly mixing it with the gas 16.

These two pipes operate only if there is a reduction in nitrogen in the flow 10 or 16. When a reduction in nitrogen is detected, all or part of the head gas from the top of the stripping column 2 is sent toward the feed of the $CO/CH_4$ column 3. By virtue of this new pipe, the flow rate of incondensables heading toward the $CO/CH_4$ column can be increased.

All or part of the incondensables from the head condenser 6 at the top of the $CO/CH_4$ column 3 are then recovered to be routed toward the $CO/N_2$ column via the impure CO line 16 that feeds the $CO/N_2$ column. By virtue of this other new pipe 26, the pressure in the $CO/N_2$ column 4 can thus be maintained if there is a deficit of nitrogen in the CO: the presence of hydrogen compensates for the lack of nitrogen.

The flow rates in each of the new pipes 24, 26 are controlled by a detector detecting minimal purity of nitrogen in the nitrogen purge 21 from the head of the $CO/N_2$ column 4, generally after passing through the exchange lines 9.

The pressure of the $CO/CH_4$ column 3 needs to be raised slightly as a result in order to be sure that the flow of incondensables will indeed be directed toward the $CO/N_2$ column 4.

The flow rate of impure CO 16 is controlled by a pressure controller added to the $CO/CH_4$ column so that the two operating pressures of the columns can be decoupled from one another.

The incondensables, including the hydrogen, at the top of the $CO/N_2$ column, are then directed toward a fuel network via the nitrogen purge pipe 21 which passes via the exchange line.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF ELEMENTS IN THE DRAWINGS

1 scrubbing column or separator
2 stripping column
3 methane/carbon monoxide separation column
4 carbon monoxide/nitrogen separation column
5 methane pumps
6 methane/carbon monoxide separation column condenser
7 methane/carbon monoxide separation column reboiler
8 stripping column reboiler
9 heat exchanger
10 synthesis gas feed
11 scrubbing methane feed
12 hydrogen-rich gas
13 stripping column feed
14 stripping column head gas
15 methane/carbon monoxide separation column feed
16 carbon monoxide/nitrogen separation column feed
17 liquid carbon monoxide reflux
18 carbon monoxide/nitrogen separation column cooler
19 pumped liquid methane

20 liquid methane purge
21 nitrogen purge
22 low-pressure carbon monoxide
23 incondensables
24 pipe carrying hydrogen-rich gas to the column 3
26 pipe carrying incondensables to the column 4
30 cold box

The invention claimed is:

1. A method for the cryogenic separation of a mixture containing at least carbon monoxide, hydrogen, nitrogen, and methane, the method comprising the steps of:

introducing the mixture, in liquid form, to the top of a stripping column under conditions effective for separation therein to form a hydrogen-lean liquid and a hydrogen-enriched gas;

introducing the hydrogen-lean liquid to a separation column under conditions effective for separation therein to form a methane-enriched liquid at a bottom portion and a carbon monoxide-enriched gas at a top portion, the separation column having a top condenser;

introducing the carbon monoxide-enriched gas from the top of the separation column to a nitrogen-removal column under conditions effective for separation therein to form a carbon monoxide-enriched liquid and a nitrogen-enriched gas containing the majority of the nitrogen present in the mixture;

determining if the nitrogen content of an identified stream (s) selected from the group consisting of the mixture, the nitrogen-enriched gas, the carbon monoxide-enriched gas removed from the top of a separation column, and combinations thereof is/are below a respective threshold(s);

selectively introducing at least part of the hydrogen-enriched gas from the stripping column to an intermediate point of the separation column based on the determined nitrogen content of the identified stream, and selectively introducing an uncondensed gas from the top condenser of the separation column to the nitrogen-removal column based on the nitrogen content of the identified stream.

2. The method as claimed in claim 1, wherein the step of determining if the nitrogen content of the identified streams (s) is/are below the respective threshold(s) is based on a signal received from a detector configured to measure the flow rate of the nitrogen-enriched gas.

3. The method as claimed in claim 1, wherein a pressure detector (PIC) is configured to control a flow rate of the carbon monoxide-enriched gas coming from the top portion of the separation column.

4. The method as claimed in claim 1, wherein the uncondensed gas from the top condenser is mixed with the carbon monoxide-enriched gas prior to introduction to the nitrogen-removal column.

5. The method as claimed in claim 1, wherein, if, and only if, the nitrogen content of the identified stream(s) is below the respective threshold(s) is at least part of the hydrogen-enriched gas sent to the separation column at an intermediate point of the separation column and is the uncondensed gas from the top condenser sent to the nitrogen-removal column.

6. The method as claimed in claim 1, wherein the mixture is a bottom liquid from a methane scrubbing column, wherein a scrubbing liquid used in the methane scrubbing column is comprised of the methane-enriched liquid received from the bottom portion of the separation column.

7. A method for the cryogenic separation of a mixture containing at least carbon monoxide, hydrogen and nitrogen, the method comprising the steps of:

introducing the mixture, in liquid form, to the top of a stripping column under conditions effective for separation therein to form a hydrogen-lean liquid and a hydrogen-enriched gas;

introducing the hydrogen-lean liquid or a fluid derived from the hydrogen-lean liquid to a nitrogen-removal column under conditions effective for separation therein to form a carbon monoxide-enriched liquid and a nitrogen-enriched gas containing the majority of the nitrogen present in the mixture; and determining if the nitrogen content of an identified stream (s) selected from the group consisting of the mixture, the nitrogen-enriched gas, and combinations thereof is/are below a respective threshold(s), selectively introducing at least part of the hydrogen-enriched gas coming from the stripping column to an intermediate point of the nitrogen-removal column based on the nitrogen content of the identified stream.

8. The method as claimed in claim 7, wherein the fluid derived from the hydrogen-lean liquid is produced by expanding the hydrogen-lean liquid through a valve.

9. A method for the cryogenic separation of a mixture comprising carbon monoxide, hydrogen and nitrogen, the method comprising the steps of:

introducing the mixture, in liquid form, to the top of a stripping column under conditions effective for separation therein to form a hydrogen-lean liquid and a hydrogen-enriched gas; and introducing the hydrogen-lean liquid or a fluid derived from the hydrogen-lean liquid to a nitrogen-removal column under conditions effective for separation therein to form a carbon monoxide-enriched liquid and a nitrogen;

selectively increasing a flow rate of incondensables introduced to the nitrogen-removal column based on the nitrogen content within the nitrogen removal column, wherein the incondensables comprise hydrogen from the hydrogen-enriched gas.

* * * * *